US007905389B2

(12) United States Patent
Ghini et al.

(10) Patent No.: US 7,905,389 B2
(45) Date of Patent: Mar. 15, 2011

(54) CONTAINER AND FOLDABLE BLANK FOR FORMING THE CONTAINER ITSELF

(75) Inventors: Marco Ghini, Monte San Pietro (IT); Fiorenzo Draghetti, Medicina (IT)

(73) Assignee: G.D. - S.p.A., Bologna (IT)

( * ) Notice: Subject to any disclaimer, the term of this patent is extended or adjusted under 35 U.S.C. 154(b) by 979 days.

(21) Appl. No.: 10/565,439

(22) PCT Filed: Jul. 26, 2004

(86) PCT No.: PCT/EP2004/008331

§ 371 (c)(1),
(2), (4) Date: Jan. 20, 2006

(87) PCT Pub. No.: WO2005/014436

PCT Pub. Date: Feb. 17, 2005

(65) Prior Publication Data

US 2006/0213789 A1 Sep. 28, 2006

(30) Foreign Application Priority Data

Jul. 29, 2003 (IT) ..... BO2003A0451

(51) Int. Cl.

| | |
|---|---|
| ***B65D 5/00*** | (2006.01) |
| ***B65D 43/16*** | (2006.01) |
| ***B65D 85/10*** | (2006.01) |
| ***B65D 85/12*** | (2006.01) |
| ***A24F 15/00*** | (2006.01) |

(52) U.S. Cl. ..... 229/146; 229/160.1; 206/268; 206/273

(58) Field of Classification Search ..... 206/268, 206/273, 424; 229/160.1, 182.1, 116.1, 146, 229/193, 172

See application file for complete search history.

(56) References Cited

U.S. PATENT DOCUMENTS

| | | | | |
|---|---|---|---|---|
| 1,645,403 | A * | 10/1927 | Rhodes | 220/62.14 |
| 2,028,276 | A * | 1/1936 | Evans | 229/109 |
| 2,318,198 | A * | 5/1943 | Clarke | 229/113 |
| 2,603,405 | A * | 7/1952 | Frankenstein | 229/146 |
| 3,708,108 | A * | 1/1973 | Rosenburg, Jr. | 229/225 |
| 3,722,783 | A * | 3/1973 | Rous | 206/521 |
| 3,836,066 | A * | 9/1974 | Del Priore et al. | 206/521 |

(Continued)

FOREIGN PATENT DOCUMENTS

DE 40 32 870 A 4/1992

(Continued)

OTHER PUBLICATIONS

International Search Report of PCT/EP2004/008331, mailed Dec. 15, 2004.

(Continued)

*Primary Examiner* — Gary E Elkins
*Assistant Examiner* — Latrice Byrd
(74) *Attorney, Agent, or Firm* — Nixon & Vanderhye P.C.

(57) ABSTRACT

Container obtained by the folding of a single respective foldable blank, is delimited by walls of which at least one is shaped in such a way as to protrude towards the outside of the container, and has at least one flat stiffening wall, which extends between two walls bordering on the shaped wall and is arranged at a distance from the shaped wall in order to make stable the shape of the latter.

30 Claims, 3 Drawing Sheets

U.S. PATENT DOCUMENTS

| | | | | | |
|---|---|---|---|---|---|
| 3,986,608 | A | * | 10/1976 | Rous | 206/424 |
| 5,097,948 | A | * | 3/1992 | Campbell | 206/268 |
| D438,106 | S | * | 2/2001 | Brown et al. | D9/432 |
| 6,370,846 | B1 | | 4/2002 | Schoch et al. | |
| 6,484,930 | B1 | * | 11/2002 | Draghetti | 229/146 |

FOREIGN PATENT DOCUMENTS

| | | | |
|---|---|---|---|
| DE | 40 32 870 | A1 | 4/1992 |
| DE | 202 08 729 | U | 8/2002 |
| DE | 202 08 729 | U1 | 9/2002 |
| JP | 3-26706 | | 3/1991 |
| JP | 5-3121 | | 1/1993 |
| JP | 10 035655 | A | 2/1998 |
| JP | 10035655 | | 2/1998 |
| WO | 99/02428 | A | 1/1999 |
| WO | WO 99/02428 | | 1/1999 |
| WO | WO 03/018408 | A2 | 3/2003 |

OTHER PUBLICATIONS

Patent Abstracts of Japan, vol. 1998, No. 06, Apr. 30, 1998.
Japanese Office Action for corresponding Japanese Application No. 2006-521499, mailed Mar. 16, 2010 (4 pages).

* cited by examiner

CONTAINER AND FOLDABLE BLANK FOR FORMING THE CONTAINER ITSELF

This application is the U.S. national phase of international application PCT/EP2004/008331, filed 26 Jul. 2004, which designated the U.S. and claims priority of IT BO2003A000451, filed 29 Jul. 2003, the entire contents of each of which are hereby incorporated by reference.

The invention relates to a container particularly intended to contain products for smokers, or food, confectionary or cosmetic products, and a foldable blank to be used for forming the container itself.

Explicit reference will be made below to containers defining cigarette packets without thereby losing general validity. Packets for cigarettes are known comprising a front wall and a rear wall having a substantially flat shape, between which two lateral shaped walls are interposed, that are convex in the specific case in relation to the exterior of the packet.

One drawback of these packets is that the convex walls are provided with little stiffness and tend to take on a flat configuration when subjected to squeezing, for example by a user who wishes to access the contents of the packet or in the event of accidental stresses arising from external bodies.

To overcome this drawback, WO 99/02428 teaches how to produce packets of the type disclosed above using flat foldable blanks, in which the side panels intended to form the convex walls of the packet are provided with a plurality of flaps arranged to be folded and then glued respectively in contact with a bottom wall and a top wall of the packet, in such a way as to confer to the latter a certain stability.

The flaps are connected to each side panel along respective straight segments that identify in the finished packet a broken line along which the flaps itselves were folded by 90° to be glued in contact with the bottom wall or with the top wall.

In order that the broken line is acceptably close to the convex contour of the side walls, it is important to provide a large number of flaps of small dimensions, connected to respective side panels along straight segments of the minimum possible length.

One drawback of the prior art disclosed above is that the flaps enable the stiffness of the convex walls to be increased only at the connection zones of these walls with the bottom wall and with the top wall, but are virtually ineffective in the intermediate zones of the convex walls, which can be deformed very easily.

Furthermore, owing to their small dimensions, the above-mentioned flaps create great folding difficulties and above all gluing difficulties in the packaging machines. It is in fact particularly difficult to apply to each flap a sufficient quantity of glue to firmly fix the flap to the bottom wall or top wall without the glue spilling over from the surface of the flap itself, thereby contaminating in an undesired manner parts of the packet and/or diminishing the cleanliness of the packaging machines.

Furthermore, however small the dimensions of the flaps, the broken line along which the flaps are folded is not able to accurately reproduce the convex contour of the side walls of the packet and is therefore responsible for faults in the connection zone between the convex wall and respectively the bottom wall or the top wall.

One object of the invention is to improve the containers provided with shaped walls that protrude towards the exterior of the container and particularly to increase the stiffness of the above-mentioned shaped walls.

A further object is to simplify the production of the containers provided with shaped walls, particularly by facilitating folding and gluing operations in the packaging machines.

Another object is to eliminate the prior-art drawbacks that are due to the flaps connected to the side panels that have to be folded and glued into contact with the bottom wall or with the top wall.

In a first aspect of the invention, a container delimited by a wall arrangement is provided comprising a shaped wall arrangement that protrudes towards the exterior of said container, said container comprising a stiffening element arranged to stiffen said shaped wall arrangement, wherein said stiffening element comprises a stiffening wall distanced from said shaped wall arrangement.

Owing to the stiffening wall, it is possible to obtain a container provided with a shaped wall arrangement provided with relatively high stability, even when subject to squeezing by a user or to accidental mechanical stresses due to external bodies.

The stiffening wall furthermore enables the flaps of the prior art to be eliminated, thereby simplifying container packaging operations, and particularly the difficulties of folding and gluing the known flaps are overcome.

In a second aspect of the invention, a foldable blank is provided for forming a container, comprising a first greater panel, a second greater panel, a longitudinal panel that extends parallel to said first greater panel, a longitudinal strip that has a longitudinal side in common with said longitudinal panel, wherein said longitudinal panel is subdivided into a first zone that has a side in common with said first greater panel, and a second zone that has a side in common with said longitudinal strip.

The foldable blank according to this aspect of the invention enables a container to be obtained that is provided with a shaped wall arrangement formed starting at the first zone of the longitudinal panel and with a stiffening wall formed starting at the second zone of the longitudinal panel. The second zone of the longitudinal panel replaces the flaps of known foldable blanks and therefore enable the stiffness of the shaped wall arrangement to be increased, thereby simultaneously overcoming the drawbacks connected with the presence of the flaps.

The invention will be better understood and implemented with reference to the attached drawings, which illustrate some embodiments by way of non-limiting example, in which.

Figure 1:
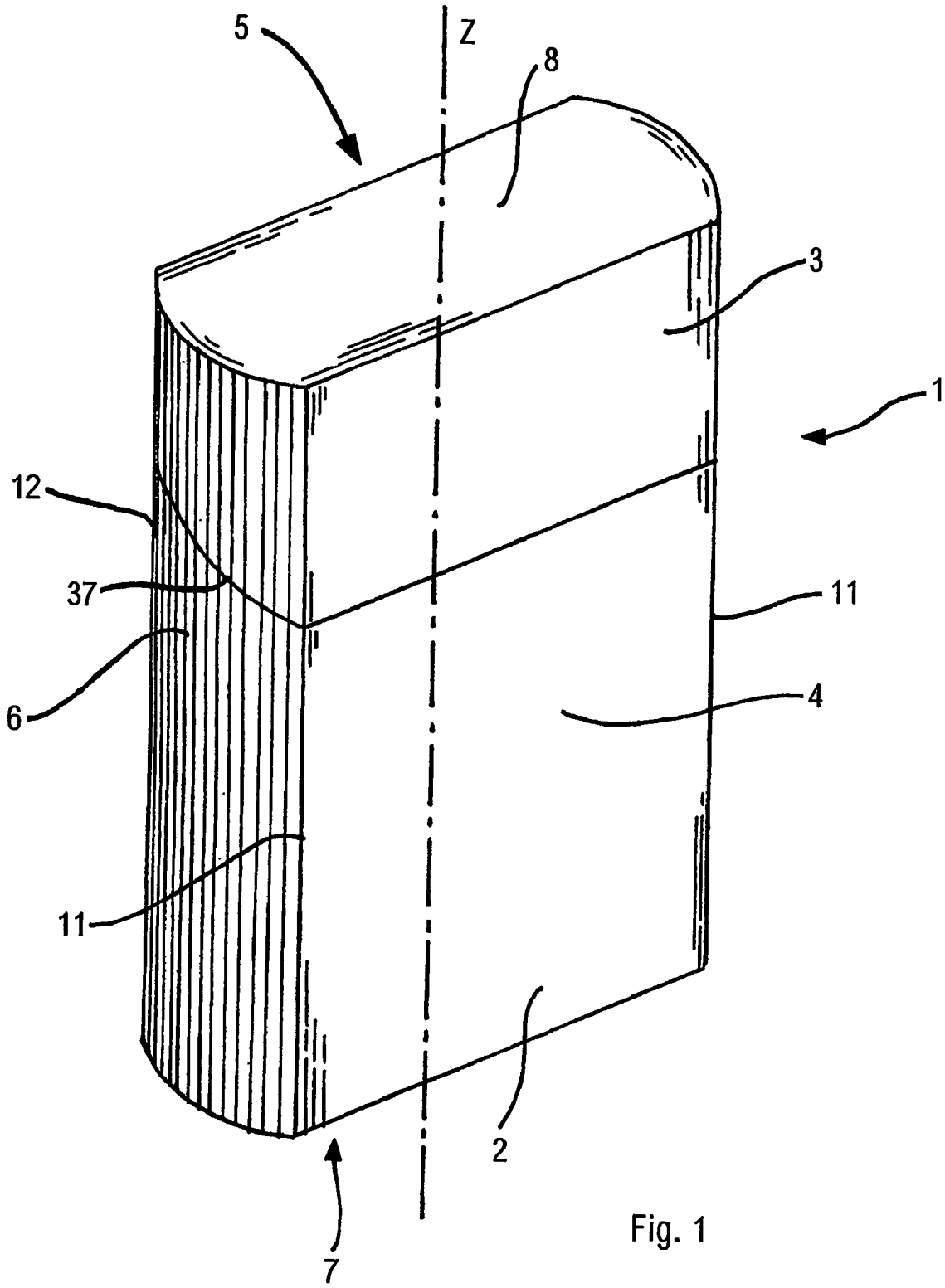
FIG. 1 is a perspective view of a container according to the first aspect of the invention.
Figure 3:
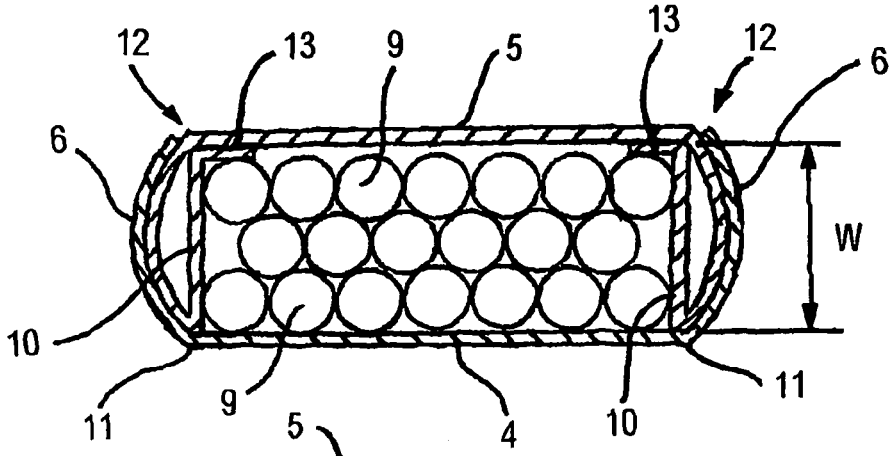
FIG. 3 is a schematic section of the container in FIG. 1 taken along a plane at right angles to the axis Z.

FIGS. 1 and 3 show a container according to the first aspect of the invention, particularly a stiff packet 1 containing products for smokers, such as for example cigarettes 9.

The packet 1 extends mainly along a longitudinal axis Z and comprises a containing body 2 closed at the top by a lid 3 hinged on the containing body 2. The lid 3 is rotationally movable between a closed position, shown in FIG. 1, and an open position that is not shown in which a user can access the products arranged inside the packet 1.

The above-mentioned packet is delimited by a front wall 4 and by a rear wall 5 parallel to one another and to the longitudinal axis Z, and by a pair of side walls 6 facing each other, connected to the front wall 4 along a pair of front longitudinal edges 11 and to the rear wall 5 along a pair of rear longitudinal edges 12. A bottom wall 7 and a top wall 8 are also provided that are parallel to one another and delimit the packet 1 perpendicularly to the longitudinal axis Z.

As shown in FIG. 3, the side walls 6 are convex towards the exterior of the packet 1 and comprise a portion of cylindrical surface passing through the respective longitudinal front edge 11 and longitudinal rear edge 12.

With the side walls 6 stiffening walls 10 are furthermore associated that are arranged to make the deformation of the side walls 6 more difficult if the packet 1 is subject to external mechanical stresses. As each stiffening wall 10 has a substantially flat geometry, it extends between a front longitudinal edge 11 and the rear longitudinal edge 12 adjacent thereto, the stiffening wall 10 being provided with an extent W in the direction of the thickness of the packet 1 substantially equal to the internal thickness of the packet.

The stiffening walls 10 are furthermore connected near the rear longitudinal edges 12 with respective anchoring walls 13 that rest on the rear wall 5 and are fixed to it, for example by gluing.

The anchoring walls 13 enable the stiffness conferred to the side walls 6 by the stiffening walls 10 to be further increased, thereby ensuring that the latter do not move when the packet 1 is subjected to mechanical stresses.

The stiffening walls 10, thus like the anchoring walls 13, extend substantially along the entire extent of the packet in the direction of the longitudinal axis Z. This enables stability to be conferred to the side walls 6 along their entire length and not only at the connection zones with the top wall 8 and with the bottom wall 7, as occurred with the flaps of the prior art.

Furthermore, owing to the considerable extent of the anchoring walls 13, if they are compared with the flaps of the prior art, it is easy to understand how the glue can be applied to the anchoring walls relatively easily without spilling over.

It should be noted that the stiffening walls 10 identify, together with the front wall 4 and the rear wall 5, an empty space having a substantially parallelepiped shape inside the packet 1. The shape of this empty space substantially corresponds to the shape of a composition of cigarettes to be introduced inside the packet 1, which enables any play between the cigarettes 9 and the packet 1 to be avoided that could cause the cigarettes 9 to get damaged.

Furthermore, inside the empty space a collar of traditional type that is not shown can be inserted.

Figure 2:
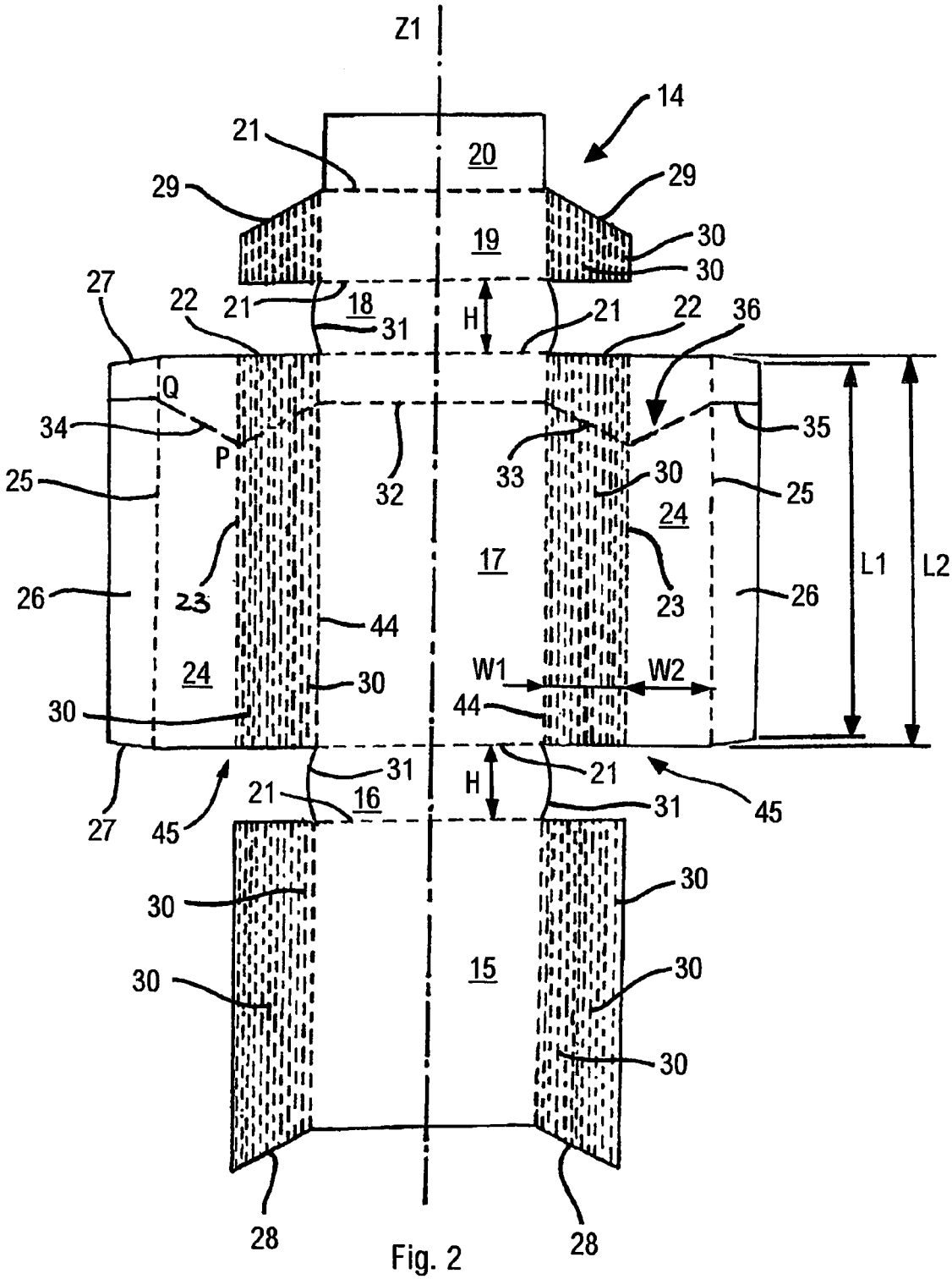
FIG. 2 is a plan view of a foldable blank suitable for forming the container in FIG. 1.

FIG. 2 shows an example of a foldable blank 14 that can be used to form the packet 1. The foldable blank 14 is for example a flat die-cut blank in cardboard that may be printed. The foldable blank 14 mainly extends along an axis of symmetry Z1 and is shown in FIG. 2 by a symbology that is usually used in the papermaking industry, and which provides for indicating the cutting lines through continuous lines and the creasing lines through broken lines.

The foldable blank 14 comprises a first greater panel 17 that extends along the axis of symmetry Z1 and is interposed between a first transverse panel 16 and a second transverse panel 18. The first transverse panel 16 is in turn connected to a second greater panel 15, whereas the second transverse panel 18 has a side in common with a smaller panel 19 from which a reinforcing flap 20 extends. The panels are connected together along transverse creases 21 that are arranged perpendicularly to the axis of symmetry Z1.

The first greater panel 17, the first transverse panel 16 and the second transverse panel 18 are arranged to form in the packet 1, respectively the rear wall 5, the bottom wall 7 and the top wall 8. The second greater panel 15 and the lesser panel 19 are on the other hand intended to form the front wall 4. The reinforcing flap 20 is arranged to be folded by 180° around the respective transverse crease 21 and glued to the lesser panel 19, to allow repeated openings of the lid 3 without damage to its front portion.

The first greater panel 17 is furthermore adjacent to a longitudinal panel 45 arranged on opposite sides of the axis of symmetry Z1. Each longitudinal panel 45 comprises a first zone 22 connected to the first greater panel 17 along a respective longitudinal border 44, and a second zone 24 adjacent to a respective longitudinal strip 26.

The first zone 22 and the second zone 24 are adjacent to one another along a first longitudinal crease 23 parallel to the axis of symmetry Z1. These zones 22 and 24 extend along the axis of symmetry Z1 substantially by the same length, this length corresponding to the length of the greater panel 17 along the axis of symmetry Z1.

Each first zone 22 is provided with a transverse extent W1 that is greater than a further transverse extent W2 of the second zone 24. Furthermore, the further transverse extent W2 of the second zone 24 substantially corresponds to dimension H of the first transverse panel 16 and of the second transverse panel 18 in the direction of the axis of symmetry Z1.

The longitudinal strips 26 are connected to the second zone 24 of the longitudinal panel 45 along second longitudinal creases 25 parallel to the axis of symmetry Z1. Such strips are trapezium-shaped, being delimited transversely to the axis of symmetry Z1, by segments 27 converging towards the exterior of the foldable blank 14. In this way, the length L1 of each longitudinal strip 26, measured in the direction of the axis of symmetry Z1 from the external part of the foldable blank 14, is slightly less than the length L2 of the respective second longitudinal crease 25. This enables interference between the longitudinal strips 26 and the first transverse panel 16 or the second transverse panel 18 to be avoided both during folding operations of the foldable blank 14 and in the finished packet 1.

On both sides of the second greater panel 15 and of the lesser panel 19 first external panels 28 and second external panels 29 are respectively provided.

In the packet 1, the first external panels 28 and the second external panels 29 are externally superimposed on the first zones 22 of the longitudinal panel 45 and are glued to them to form the side walls 6. The first external panels 28, the second external panels 29 and the first zones 22 of the longitudinal panel 45 are provided with a plurality of longitudinal creases 30 that enable the panels 28 and 29 and the zones 22 to take on an arched configuration corresponding to the curved borders 31 that laterally delimit the first transverse panel 16 and the second transverse panel 18, in such a way as to create in the packet 1 concave side walls 6 of the type shown in FIG. 3.

During packaging of the packet 1, the second zones 24 of the longitudinal panel 45 are folded inside the first zones 22 in such a way as to extend between a front longitudinal edge 11 and the corresponding rear longitudinal edge 12. The longitudinal strips 26 are folded 90° in relation to the second zones 24, until they come to rest against the first greater panel 17 that forms the rear wall 5, and are subsequently glued into contact with the panel. In this way the configuration shown in FIG. 3 can be obtained.

On the first greater panel 17 a hinge crease 32 is furthermore provided that is perpendicular to the axis of symmetry Z1, which in the finished packet 1 forms a hinge around which the lid 3 can be rotated to access the cigarettes 9.

From the two sides of the hinge crease 32 located on opposite sides in relation to the axis of symmetry Z1 respective tilted cutting lines 33 depart that extend through the first zones 22 in a tilted direction to the first transverse panel 16 and terminate on the first longitudinal creases 23 at respective points P. From these points further tilted cutting lines 34 extend that cross the second zones 24 in a direction tilted towards the second transverse panel 18. The tilted cutting lines 33 and the further tilted cutting lines 34 are specular to one another in relation to the respective first longitudinal creases 23. The further tilted cutting lines 34 terminate on the second longitudinal creases 25 at the further points Q from which horizontal cutting lines 35 extend that are arranged transversely to the longitudinal strips 26.

Along the tilted cutting lines 33 and the further tilted cutting lines 34 joints 36 are provided that facilitate the handling of the foldable blank 14.

In the finished packet 1, the horizontal cutting lines 35 of the longitudinal strips 26 are arranged along the rear wall 5 near the hinge line 32 and enable the lid 3 to be opened and/or closed without additional effort compared with the effort required to overcome the resistance of the hinge line 32. The tilted cutting lines 33 and the further tilted cutting lines 34, after being placed side by side during packaging of the packet, form the tilted borders 37 of the lid 3. The user opening the packet 1 for the first time breaks the joints 36 to access the cigarettes 9 housed in the containing body 2.

FIGS. from 4 to 7 show some alternative embodiments of the container according to the invention.

Figure 4:
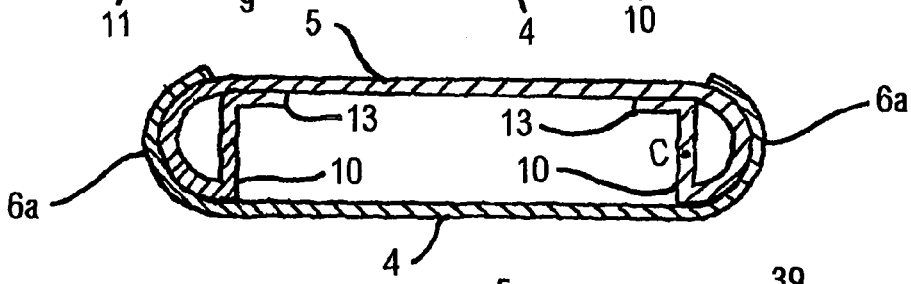
FIGS. 4 to 7 are schematic sections like the one in FIG. 3 showing some alternative embodiments of the container in FIG. 1.

The container shown in FIG. 4 is delimited not only by the front wall 4 and by the rear wall 5 that are parallel to each other and are substantially flat but also by a pair of side walls 6*a* each one of which comprises a semicylindrical portion the axis of which passes through point C arranged about half way along the stiffening wall 10.

This container can be obtained by starting with a foldable blank like the one in FIG. 2, in which the first zones 22, the first external panels 28 and the second external panels 29 each have a transverse extent W1 that is approximately 3.14/2 times the further transverse extent W2 of each second zone 24.

Figure 5:
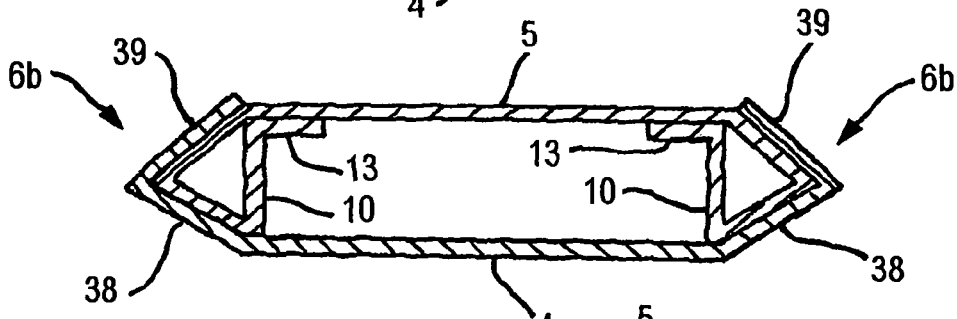

FIG. 5 shows a container whose side walls 6*b* comprise a pair of first side walls 38 adjacent to the front wall 4 and a pair of second side walls 39 adjacent to the rear wall 5 in such a way as to define a prism having a transverse section like an irregular hexagon. The first side walls 38 and the second side walls 39 have a substantially flat shape.

The container in FIG. 5 can be obtained from a foldable blank similar to the one in FIG. 2; in which the plurality of creases 30 of the first zones 22 of the first side panels 28 and of the second side panels 29 is replaced by a single intermediate crease parallel to the axis of symmetry Z1 and equidistant from the longitudinal borders of the side panels and of the second zones.

Figure 6:
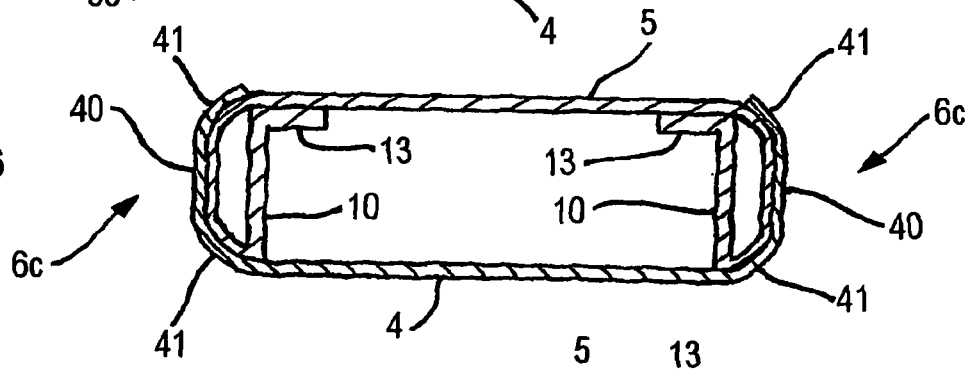

FIG. 6 shows an embodiment of a container provided with side walls 6*c* comprising a substantially flat intermediate portion 40 connected to the front wall 4 and to the rear wall 5 by peripheral portions 41 provided with a curved geometry. The peripheral portions 41 may for example have a transverse section like a circumference arch. The container in FIG. 6 can be obtained starting from a foldable blank like the one in FIG. 2, in which the first zones 22, the first external panels 28 and the second external panels 29 are provided with a central region without creases and with two bundles of multiple creases arranged at the borders of the central region in such a way as to form curved peripheral portions 41 in the finished container.

Figure 7:
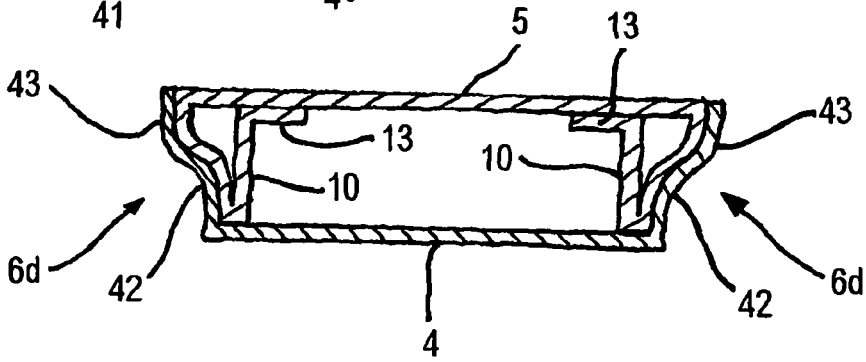

Lastly, in the embodiment in FIG. 7, side walls 6*d* are provided, each one of which comprises a first convex portion 42 that has a convex-shaped transverse section, the convexity of which is turned towards the inside of the container, and a second portion 43, provided in a cross-section with a concave shape, the concavity of which is turned towards the inside of the container. The first portion 42 may for example be adjacent to the front wall 4 whereas the second portion 43 is adjacent to the rear wall 5.

All the embodiments of the FIGS. from 3 to 7 comprise stiffening walls 10 designed to prevent or at least reduce the deformation of the side walls 6, 6*a*, 6*b*, 6*c*, 6*d* and connected to anchoring walls 13 folded in contact with the rear wall 5 and that are made integral with it by means of gluing.

The anchoring walls and the stiffening walls may be provided not only in the case of containers provided with side walls having one of the shapes indicated in FIGS. 3 to 7 but in general in the case of containers provided with one or more formed walls protruding towards the exterior of the container, which would tend to become deformed, for example taking on a flat configuration, when subject to squeezing or other external mechanical stress.

The invention claimed is:

1. Stiff packet with a hinged lid for cigarettes, wherein said packet comprises a containing body closed at the top by a lid hinged on the containing body and said lid is rotationally movable between a closed position and an open position, and wherein said packet is delimited by a wall arrangement comprising a substantially flat front wall, a substantially flat rear wall and a pair of shaped side walls that protrudes towards the exterior of said container, each shaped side wall being connected to said front wall along a first edge, and to said rear wall along a second edge, each shaped side wall comprising an outer shaped panel attached to an inner shaped panel, wherein said packet comprises a stiffening element arranged to stiffen said shaped side walls, wherein said stiffening element comprises a substantially flat stiffening wall extending from said first edge to said second edge, said stiffening element being spaced from the corresponding shaped side wall and having a length the same as a longitudinal dimension of said shaped side wall, said length and said longitudinal dimension being measured parallel to said first edge, such that said front wall, said rear wall and said stiffening walls define an empty parallelepiped space which corresponds to the shape of a composition of cigarettes to be introduced inside the packet and said packet further comprises a gap between each shaped side wall and its corresponding stiffening wall.

2. Packet according to claim 1, and furthermore comprising an anchoring element arranged to anchor said stiffening wall to supporting wall adjacent to said shaped side wall.

3. Packet according to claim 2, wherein said anchoring element comprises an anchoring wall adjacent to said shaped side wall.

4. Packet according to claim 3, wherein said anchoring wall has a longitudinal extent measured parallel to said first edge substantially the same as said length of said stiffening wall.

5. Packet according to claim 3, wherein said anchoring wall has a substantially flat shape and is fixed to a flat portion of said supporting wall.

6. Packet according to claim 3, wherein said anchoring wall is glued to said supporting wall.

7. Packet according to claim 3, wherein said anchoring wall is rotated by approximately 90° in relation to said stiffening wall.

8. Packet according to claim 1, wherein each shaped side wall comprises at least a convex portion.

9. Packet according to claim 8, wherein said convex portion comprises a portion of cylindrical surface.

10. Packet according to claim 9, wherein said portion of cylindrical surface comprises a semicylindrical surface that extends around an axis substantially passing through said stiffening wall.

11. Packet according to claim 1, wherein each shaped side wall comprises a first flat wall and a second flat wall that intersect each other along a common edge.

12. Packet according to claim 8, wherein said shaped side wall comprises a substantially flat intermediate portion and convex peripheral portions.

13. Foldable blank for forming a hinged-lid packet of cigarettes, the hinged-lid packet being delimited by a wall arrangement comprising a front wall, a rear wall, a pair of shaped side walls, a top wall and a bottom wall, the blank comprising a first greater panel, a second greater panel, external panels provided at opposite sides of said second greater panel, a longitudinal panel and a further longitudinal panel respectively arranged on opposite sides of said first greater panel parallel to said first greater panel, a pair of longitudinal strips each having a longitudinal side in common respectively with said longitudinal panel or with said further longitudinal panel, wherein said longitudinal panel and said further longitudinal panel are each subdivided into a first zone having a side in common with said first greater panel and a second zone having a side in common with the corresponding longitudinal strip, a first longitudinal crease separating said first zone from said second zone, a second longitudinal crease separating said longitudinal strip from said second zone, wherein each of said first zone and said second zone has a transverse extent measured perpendicular to a longitudinal axis along which said longitudinal panel extends, and wherein said first greater panel is interposed between a first transverse panel and a second transverse panel lying on opposite sides of said first greater panel along said longitudinal axis, said first greater panel, said first transverse panel, and said second transverse panel being arranged to form in the packet, respectively, said rear wall, said bottom wall and said top wall, each of said panels being superimposed in the packet on the respective first zones of said longitudinal panel and said further longitudinal panel to form said shaped side walls, and wherein said first transverse panel and said second transverse panel extend parallel to said longitudinal axis by a quantity substantially corresponding to said extent of said second zone.

14. Foldable blank according to claim 13, wherein said transverse extent of said first zone has greater than said transverse extent of said second zone.

15. Foldable blank according to claim 13, wherein said first zone extends parallel to said first longitudinal crease for a length substantially the same as the length of said first greater panel along said first longitudinal crease.

16. Foldable blank according to claim 13, wherein said second longitudinal crease is substantially parallel to said first longitudinal crease.

17. Foldable blank according to claim 16, wherein said longitudinal strip has a longitudinal extent measured parallel to said second longitudinal crease substantially equal to said length of said second zone.

18. Foldable blank according to claim 13, wherein said longitudinal strip is trapezium-shaped, said second longitudinal crease defining a larger base of said trapezium.

19. Foldable blank according to claim 13, wherein said first zone is provided with a cutting line that extends through said first zone in a tilted direction in relation to said first longitudinal crease.

20. Foldable blank according to claim 19, wherein said second zone is provided with a further cutting line that extends through said second zone in a direction tilted in a specular manner in relation to said cutting line with respect to said first longitudinal crease.

21. Foldable blank according to claim 20, wherein said cutting line and said further cutting line are provided with joints.

22. Foldable blank according to claim 13, wherein said first zone is provided with a plurality of creases parallel to one another arranged to give said first zone a certain yieldability, such that said first zone may take on a concave configuration when folded.

23. Foldable blank according to claim 22, wherein said first zone is provided with a first bundle of multiple creases and a second bundle of multiple creases arranged at the borders of a central region without creases.

24. Packet according to claim 8, wherein each shaped side wall comprises a convex wall.

25. Container delimited by a wall arrangement comprising a front wall, a rear wall and a pair of side walls, each side wall being connected to said front wall along a first fold line, and to said rear wall along a second fold line, each side wall comprising an outer panel attached to an inner panel, said container further comprising a stiffening element for each of said side walls, wherein each said stiffening element comprises a substantially flat stiffening wall spaced from the corresponding side wall, each said stiffening wall having a first end positioned at the first fold line and a second end positioned at the second fold line.

26. Container according to claim 25, wherein each said stiffening wall has a length the same as a longitudinal dimension of said side wall, said length and said longitudinal dimension being measured parallel to said first fold line.

27. Container according to claim 25, further comprising a lid hinged to the rear wall.

28. Container according to claim 25, further comprising an empty parallelepiped space, for contents of the container, defined by the front wall, rear wall and said stiffening elements.

29. Container according to claim 28, further comprising a gap between each side wall and the stiffening element, each said gap being substantially symmetrical about a horizontal plane extending from one said gap to another said gap.

30. Container according to claim 28, wherein the first and second fold lines correspond to the lateral extremes of the empty space.

* * * * *